United States Patent [19]

Johnson et al.

[11] 4,426,120

[45] Jan. 17, 1984

[54] SECTIONED CABINET FOR ROOM AIR CONDITIONING UNIT

[75] Inventors: Walter T. Johnson, Fridley; Nelson B. Gross, Champlin, both of Minn.

[73] Assignee: McQuay Inc., Minneapolis, Minn.

[21] Appl. No.: 255,555

[22] Filed: Apr. 20, 1981

[51] Int. Cl.[3] ..... A47B 87/00

[52] U.S. Cl. ..... 312/100; 312/107; 312/111; 312/205; 206/321

[58] Field of Search ..... 312/100, 101, 102, 257 SK, 312/111, 205, 236, 107, 140; 206/321; 220/4 C

[56] References Cited

U.S. PATENT DOCUMENTS

| | | | |
|---|---|---|---|
| 470,152 | 3/1892 | Buechele | 312/107 |
| 1,398,852 | 11/1921 | Gilbert | 312/140 |
| 1,664,465 | 4/1928 | Purchas | 312/205 |
| 2,115,720 | 5/1938 | Holmes | 312/236 |
| 2,511,949 | 6/1950 | Simon | 312/111 |
| 2,514,631 | 7/1950 | Elvers | 312/257 SK |
| 2,577,528 | 12/1951 | Kennedy | 312/205 |
| 2,589,319 | 3/1952 | Albrecht | 312/205 |
| 2,593,998 | 4/1952 | Dupuis | 312/107 |
| 2,598,957 | 6/1952 | Wolfe | 312/100 |
| 3,012,762 | 12/1961 | Norris . | |
| 3,012,835 | 12/1961 | Anderson et al. | 312/205 |
| 3,903,217 | 9/1975 | Heneby et al. | 312/205 |
| 4,047,776 | 9/1977 | Krick et al. | 312/101 |
| 4,093,071 | 6/1978 | Stahl et al. . | |
| 4,206,956 | 6/1980 | Lydmar | 312/111 |

FOREIGN PATENT DOCUMENTS

| | | |
|---|---|---|
| 513877 | 1/1981 | Australia . |
| 2078371 | 10/1971 | France . |
| 2140715 | 12/1972 | France . |

*Primary Examiner*—Victor N. Sakran

*Attorney, Agent, or Firm*—Merchant, Gould, Smith, Edell, Welter & Schmidt

[57] ABSTRACT

A cabinet for a vertical room air conditioning unit includes an upper section and a separate lower section having substantially similar cross-sectional dimensions to permit mating of adjacent ends when the upper section is stacked upon the lower section in a use position. Securing means, including tabs and screws hold the sections together in the use position, and the upper section acts as a plenum or air duct for the unit. For shipment or storage, the upper section telescopes down onto the lower section, and after having been rotated 90 degrees in the preferred embodiment, to form a compact space saving package.

3 Claims, 4 Drawing Figures

SECTIONED CABINET FOR ROOM AIR CONDITIONING UNIT

FIELD OF THE INVENTION

The invention pertains to room air conditioning (including heating and/or cooling) units, and in particular to an improved cabinet for room air conditioning units which is formed in sections in a manner which permits telescoping or nesting of one section onto the other to make a more compact unit for purposes of shipment.

BACKGROUND OF THE INVENTION

Room air conditioning units are widely used in a variety of applications, including apartment buildings, office buildings and houses. Individual room units, when connected into a central heating or cooling system, offer the advantages of efficiency in heating or cooling the desired areas, and aesthetic and architectual efficiency in terms of modest space requirements and, in the case of vertical room units, ease of interconnection of units on adjacent floors throughout the building.

Vertical room air conditioning units as widely used in the prior art include an elongate cabinet or housing which extends substantially from floor to ceiling along a wall or in a corner of the room. The air conditioning components for the heating or cooling function are contained in the housing. In one type of unit known as a fan coil unit, a heat exchanger and a blower are provided. Air inlets and outlets are provided in the cabinet, so that the blower draws air through the inlet, forces it through the heat exchanger, and out the air outlet back into the room. The heat exchanger is in fluid communication with a source of heated fluid (usually water) in the case of heating operation, or cooled fluid, in the case of cooling operation. The heating or cooling fluid (depending on the season) is supplied from heating or cooling equipment which is remote from the room unit and which usually services a large number of such room units throughout the building. The heating or cooling fluid is supplied to the room units through vertical pipes, also called risers, which are positioned within the unit or are attached along the outside of the units, and which extend from floor to ceiling and therethrough to connect to the risers for room units in the adjacent floors above and below. The risers are connected into a circulating path for the heating or cooling fluid, and in each room unit taps or connections are provided to pass some of the fluid to the heat exchanger. Usually a thermostatic control is provided with each room unit to operate its blower or a valve controlling the connection of the heat exchanger to the risers.

Another type of room air conditioning unit uses heat pump, or reversible refrigeration cycle equipment within the individual room units. These type of units have a refrigerant, compressor, heat exchangers, and a blower to establish heat flow between the air in the room and the circulating fluid from the risers. Suitable controls are provided so that the unit can deliver heat to the room from the circulating fluid in the risers, or alternatively can remove heat from the room and apply it to the circulating fluid. This type of operation has the known advantages of allowing heating in some zones or areas of the building while simultaneous cooling is taking place in others, to accommodate different heating or cooling requirements in different zones of a building, for example in response to direct sunlight on some rooms.

Both types of units, fan coil and heat pump or reversible refrigeration cycle, use the same general type of cabinet, and while the improved cabinet of the present invention is shown applied to a fan coil unit, it is also applicable to heat pump units, as explained more fully later herein. As used herein, the term "air conditioning" is used in a broad sense to include conditioning of air by heating it, cooling it, or both. The present invention is applicable to units which are designed to provide heat only, cooling only, or either heating or cooling, whether by fan coil operation or reversible heat pump operation.

In a room air conditioning unit, the air conditioning components (heat exchanger, motor, etc.) generally take up less than half of the volume within the elongated cabinet, the remainder of the volume serving as a plenum or air duct for the room air that is drawn through the unit, passed through the heat exchanger, and returned to the room. The air conditioning components are usually mounted in the lower part of the cabinet for considerations of ease of servicing and also for structural considerations. This means that the upper portion of a vertical unit is basically empty. Because vertical room air conditioning units are full room height, they are somewhat bulky and take up a considerable amount of space during shipment and storage from the time they are manufactured until the time they are installed in a room. Their size and bulk also requires a considerable amount of packing material for shipment to adequately protect the panels from damage during shipment. Since the front and sides are finished and are visible and become part of the room decor in the final installation, great care must be taken in packaging of the units for shipment.

SUMMARY OF THE INVENTION

The present invention provides a sectioned cabinet for a vertical room air conditioning unit, including upper and lower housing sections each having walls defining generally rectangular enclosures. Means are provided within the lower housing section for attachment and support of the air conditioning components, such as a heat exchanger, a blower and the like. The upper and lower housing sections are of substantially the same dimensions, in horizontal cross section, so that the base part of the upper housing section conforms substantially to the top portion of the lower housing section when the upper section is stacked upon the lower section in the use position in an installation. In that position, the upper housing section forms an air passage or plenum for the air conditioning unit.

However, for shipment or storage, the upper housing section telescopes or nests onto the lower housing section to provide a compact unit which takes up only about half the volume of a prior art unit for shipment or storage. The sectioned cabinet of this invention when telescoped or nested also takes considerably less packing material for protection during shipment.

Means are provided for securing the upper housing section to the lower housing section in the stacked, use position. In a preferred embodiment, this includes tabs formed along the upper edge of the lower housing section, plus a plurality of screws. The tabs are preferably formed in the sheet metal side walls of the lower housing section by punching or cutting an inverted U-shaped cut-out to form an upward extending tab. However, the tabs are preferably left flush with the side walls to permit telescoping or nesting. At the time of installation at the site, the tabs are bent outward so as to receive the lower edges of the upper housing section as they are stacked in place.

According to a preferred form of invention, the rectangular dimensions of the upper and lower housing sections are selected so that the nesting is accomplished by rotating the upper housing section 180 degrees with respect to the lower housing section, then lowering it onto the lower section. For use and installation, the upper section is pulled off the lower section, then rotated 180 degrees from the nesting position to line up with the lower section for the use position. In a preferred embodiment the upper and lower housing sections are square in cross section, and they can be installed in an alternative use position in which the upper section is rotated 90 degrees with respect to the lower section.

DETAILED DESCRIPTION OF THE PREFERRED EMBODIMENT

Figure 1:
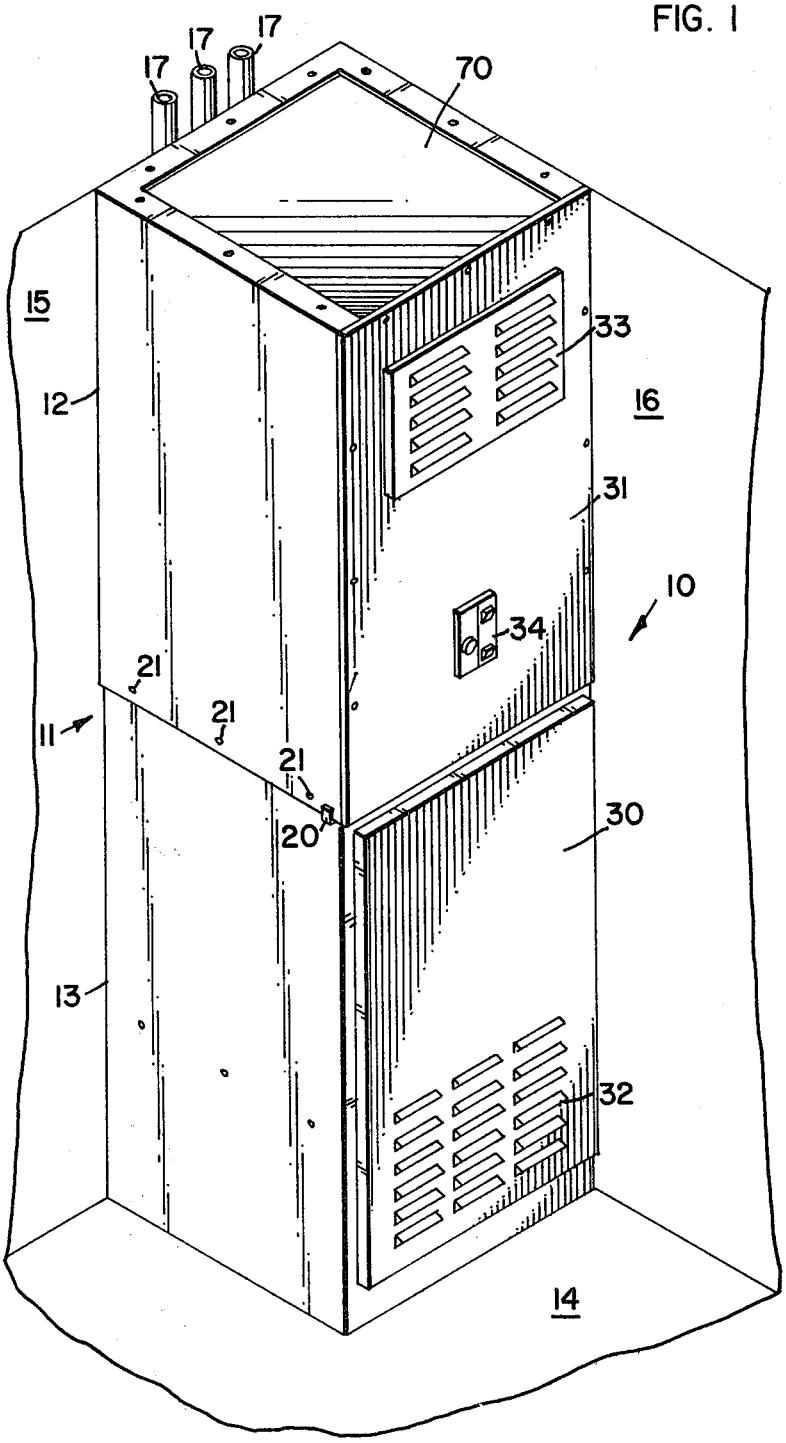
FIG. 1 is a view in perspective of a room air conditioner having a sectioned cabinet according to the present invention, in use position in a room.

In FIG. 1 reference number 10 generally designates a vertical room air conditioning unit incorporating the sectioned cabinet 11 of the present invention. The sectioned cabinet consists of an upper housing section 12 and a lower housing section 13. When assembled in the use position, upper housing section 12 is stacked on top of lower housing section 13, and is secured thereto by attachment means which includes tab 20 and a plurality of screws 21, as explained more fully hereinafter with reference to other figures. When so assembled, the cabinet extends from the floor 14 of the room to the ceiling, and may be placed along a wall or in a corner. In FIG. 1, the unit is placed in the corner of a room at the intersection of walls 15 and 16. A plurality of riser pipes 17 are attached along the back side of the cabinet, and extend beyond the full length thereof for connection to similar units on adjacent floors.

At the front of lower housing section 13 there is provided a door panel assembly 30, and at the front of upper housing section 12 there is provided a front panel assembly 31. These components are shown in their operative position in FIG. 1 on the fronts of their respective units. Door panel assembly 30 includes an air inlet 32, which may consist of a plurality of louvers in the lower portion of the door, and front panel 31 contains an air outlet 33, which similarly may consist of a plurality of louvers, towards the top of front panel 31. Thermostatic controls as are generally known in the art may be provided and mounted in front panel 31 for operation by persons in the room. The controls 34 are connected to the air conditioning components in the conventional manner, and therefore are not described in further detail here.

Figure 2:
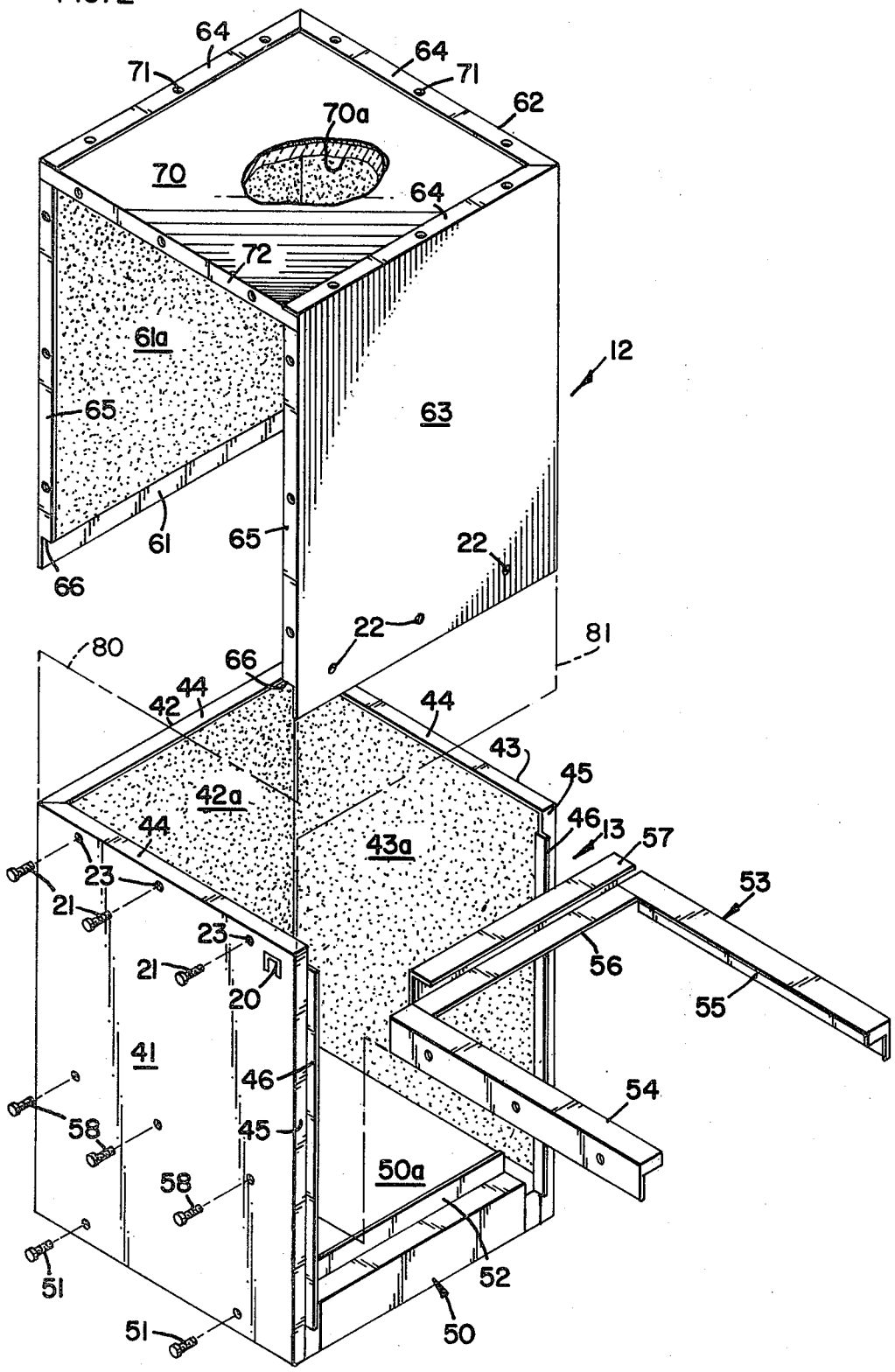
FIG. 2 is an exploded view in perspective of the cabinet illustrating the manner in which it would be oriented for telescoping or nesting.

Referring now to FIG. 2, the lower housing section 13 consists principally of a sheet metal piece bent around three sides to form an enclosure. The sheet metal piece includes a side 41, a back 42, and second side 43. Flanges 44 are formed along the top edges of sides 41 and 43 and back 42, and flanges 45 are formed along the front edges of side panels 41 and 43. Further flanges 46 are formed on flanges 45 for attachment of the door assembly 30 of FIG. 1, which is not shown in FIG. 2.

A bottom panel assembly 50 is sized to fit within the rectangular enclosure formed by lower housing section 13, and is secured along the bottom thereof by a plurality of sheet metal screws 51, two of which are seen in the view FIG. 2. Bottom panel 50 includes a flange 52 formed along its front edge, which cooperates with the door assembly.

A support fan deck 53 is also installed within lower housing section 13. Fan deck support 53 consists of a pair of side rail members 54 and 55 which are L-shaped in cross section, and a back piece 56 which includes a mounting flange 57. Fan deck support 53 is positioned within lower housing section 13 and held in place by a plurality of sheet metal screws 58 which extend through side panels 41 and 43 to secure side rails 54 and 55, respectively. Fan deck support 53 provides a mounting space for a heat exchanger, blower or other air conditioning components to be installed into the room air conditioning unit, as is generally known. In addition, support 53 provides stiffening and support for the lower housing section, as does bottom panel 50.

Insulation is provided for the walls 41, 42 and 43, and the bottom panel 50, consisting of panels of fibrous insulation material which are cut to appropriate size and secured to their respective panel, as by an adhesive. In FIG. 2, insulation panels **42*a* and 43*a* are seen positioned along the insides of walls 42 and 43 respectively. A similar panel is positioned inside wall 41, but is not visible in FIG. 2. A similar insulation panel 50*a* is secured to the bottom panel 50**.

In the exploded view of FIG. 2, for purpose of illustration, the upper housing section 12 is seen raised above lower housing section 13, and rotated 90 degrees with respect thereto, in a clockwise direction when viewed from the top. Upper housing section 12 consists of a sheet metal piece which has been formed into a three-sided enclosure having sides 61 and 63, and back 62. The upper edge of housing 12 has flanges 64 formed therein. Flanges 65 are formed in the forwarded edges of sides 61 and 63 and these extend to ends 66, just short of the bottom edge of the upper housing section. Insulation panels are secured to the insides of side walls 61 and 63, and back wall 62 of the upper housing section. One of the insulation panels, **61*a*, is visible in FIG. 2. The insulation panels have roughly the same thickness as flanges 65, and also stop short of the bottom edges of the upper housing section, at ends 66** of the flanges.

A sheet metal top panel 70 has a rectangular shape sized to fit within the enclosure dimension of upper housing section 12, and is secured to the flanges 64 of sides 61, 63 and back 62 by a plurality of sheet metal screws which would pass through holes 71. Top panel 70 has a flange 72 along its front edge. Holes are provided in flange 72 and flanges 65 to receive screws holding the front panel 31 of FIG. 1. Top panel 70 also has an insulation panel **70*a*** secured thereto.

For shipment and storage prior to installation in a room, upper housing section 12 is rotated 180 degrees with respect to the lower housing section and then telescopes or nests downwardly onto the lower housing section 13. In other words, in the shipment position the front of the upper section coincides with the back of the lower section. With reference to FIG. 2, upper housing section 12 is rotated a further 90 degrees as indicated by projection lines 80, 81 and is then lowered down over lower housing section 13. The width and depth of the cross sections of the two units are dimensioned so that the back wall 62 of the upper housing section will fit over the open front of the lower section. Wall 61 fits over side 43 of the lower housing section, and wall 63 fits over side 41. If necessary the sheet metal structure of the upper or lower housing section can be "sprung" very slightly to accommodate the telescoping fit. The insulation material lining the upper housing section will compress to allow the fit.

With the upper housing section telescoped or nesting onto the lower housing section, the total volume occupied by the cabinet is essentially the same as for the larger of the two sections alone. The volume involved during shipment or storage is therefore greatly reduced, and the amount of packaging materials required to protect the panels of the cabinet during shipment is likewise greatly reduced.

Figure 3:
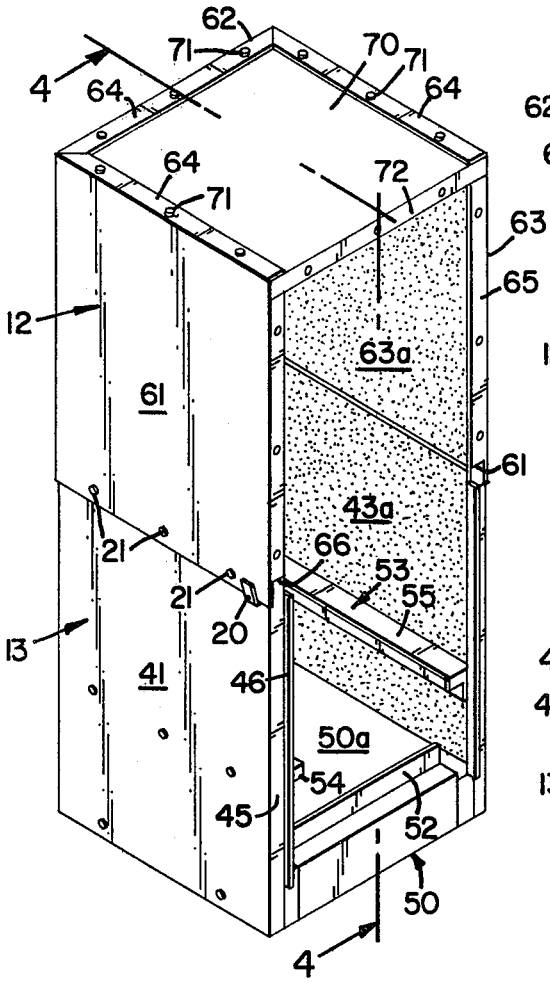
FIG. 3 is a view in perspective of the cabinet assembled to the use position.
Figure 4:
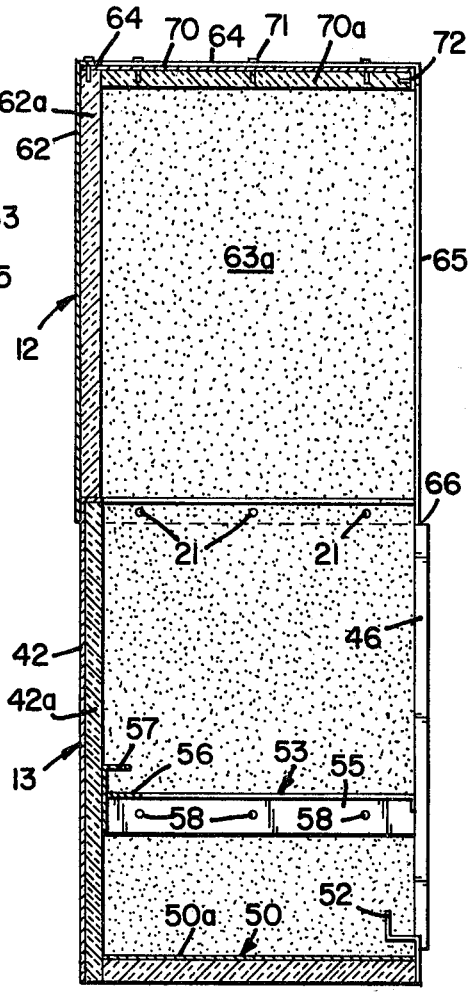
FIG. 4 is a view in cross section of the cabinet of FIG. 3, taken along line 4—4 thereof.

For use, the upper housing section 12 is removed from the lower housing section 13. Prior to stacking the upper housing section on the lower housing section, tab 20 in side wall 41, and a corresponding tab in side wall 43 are bent out at approximately a 30 degree angle, as seen in FIGS. 1 and 3. Tab 20 is initially formed by a stamping process which punches out an inverted U-shaped notch, to leave tab 20 near the forward upper edge of side wall 41. Tabs 20 are left flush with the side walls for purposes of telescoping and nesting. However for installation, they are bent outward at an angle so as to receive the bottom edges of the side walls of upper housing section 12, as seen in FIGS. 1 and 3. These tabs help support the upper section, which of course is rotated so that its front, sides and back align with the front, sides and back of the lower section. A plurality of screws 21 pass through holes 22 in the side walls of the upper housing section and matching holes 23 in the upper edges of lower housing section side walls to complete the joining of the two cabinets. If desired, additional tabs or screws could be provided at additional locations, including the back.

In the preferred embodiment, the upper and lower housing sections have square cross sections, and this permits an alternate use position with the upper housing section rotated 90 degrees with respect to the lower housing section. With reference to FIG. 2, this alternate use position would be accomplished by lowering the upper housing section 12 directly onto lower housing section 13 without the additional 90 degree rotation which was previously described. This alternate use position would permit drawing the room air in one side and discharging it in a different direction, and might be useful in some installations. This alternate use position preferably would involve additional U-shaped tabs 20 formed in the back 42 of the lower housing section, to aid in supporting the upper housing section.

With the upper housing section in place, the unit can be installed in the room, including connecting up the air conditioning components, which would be positioned on fan deck support 53, to the risers and controls. In use, air would be drawn in through the air inlet in the front of the lower housing section, driven through the heat exchanger and into the enclosed space of the upper housing section. In the use position, the upper housing section comprises a plenum or duct for the room air conditioning unit. The conditioned air is then exhausted through the air outlet provided in the upper housing section. Alternatively, the air flow direction could be reversed.

In the preferred embodiment, the "break" in the cabinet between the upper and lower sections is at about the midpoint, and this is the most efficient in terms of space saving to be gained by the telescoping or nesting. In the case of the fan coil room air conditioning unit, the blower, heat exchanger and associated components can easily fit in the lower housing section 13. In the case of a room air conditioning unit having a greater number of air conditioning components, such as would be the case with a reversible refrigeration cycle heap pump unit, it may be desirable to make the division between the upper and lower housing sections somewhat higher up on the unit, so that the lower housing section is taller and can accommodate the additional components. While this would result in a lesser space savings by nesting, it still might be preferable to having some of the air conditioning components mounted within the upper housing section, which would of course require their installation in the upper housing section at the installation site.

It is thus apparent from the above description and drawings that the present invention provides an improved cabinet for a room air conditioning unit, which is sectioned and dimensioned to permit telescoping or nesting during shipment and easy stacking and securing to the use position at the installation site.

What is claimed is:

1. A sectioned cabinet for a vertical, room air conditioning unit, comprising:

a lower housing section having walls defining a generally rectangular enclosure and a cross-section of predetermined dimensions;

means attached within said lower housing section for supporting air conditioning components including a heat exchanger and a blower;

an upper housing section including walls defining a generally rectangular enclosure and a cross-section substantially the same as said lower housing, said upper section being dimensioned to permit telescoping said upper housing section onto said lower housing section in a storage or shipment position; and means, substantially flush with said walls while in the storage or shipment position, for securing said upper housing section to said lower housing section in stacked relationship in a use position to provide an elongate cabinet for a vertical room air conditioning unit with said upper housing section comprising an air passage for the air conditioning unit in a use position;

said upper and lower housing sections being square in cross section and dimensioned to permit stacking said upper housing section on said lower housing section in the use positions by rotating it one-quarter turn or one-half turn from the storage or shipment position.

2. A sectioned cabinet for a vertical room air conditioning unit, comprising:

a lower housing section having walls defining a generally rectangular enclosure;

means attached within said lower housing section for supporting air conditioning components including a heat exchanger and a blower;

an upper housing section including walls defining a generally rectangular enclosure;

said upper and lower housing sections each being square in cross section and dimensioned to permit stacking the upper housing section on the lower housing section in a use position by rotating it one-quarter turn or one-half turn from a storage or shipment position, said housing sections further being dimensioned to permit telescoping said upper housing section onto said lower housing section in a storage or shipment position by rotating said upper housing section one-half turn from the use position; and means for securing said upper housing section to said lower housing section in stacked relationship in the use position to provide an elongate cabinet for a vertical room air conditioning unit with said upper housing section comprising an air passage for the air conditioning unit in the use position.

3. A sectioned cabinet according to claim 2 wherein said means for securing includes a plurality of tabs formed in and flush with the walls of said lower housing section near the upper edge thereof, said tabs each being adapted to be bent outwardly to receive a lower edge of a wall of said upper housing section in the use position.

* * * * *